United States Patent [19]

Barrett

[11] Patent Number: 4,677,897

[45] Date of Patent: Jul. 7, 1987

[54] ANTI-ARMOR GUN

[76] Inventor: Ronnie G. Barrett, 745 E. Vine St., Murfreesboro, Tenn. 37130

[21] Appl. No.: 563,234

[22] Filed: Dec. 19, 1983

[51] Int. Cl.[4] ..... F41D 3/06

[52] U.S. Cl. ..... 89/166; 89/148; 89/183; 89/198

[58] Field of Search ..... 89/166, 172, 182, 183, 89/159, 185

[56] References Cited

U.S. PATENT DOCUMENTS

| | | | |
|---|---|---|---|
| 512,437 | 1/1894 | Griffiths et al. | 89/172 |
| 783,123 | 2/1905 | Mauser | 89/166 |
| 1,096,324 | 5/1914 | Stamm | 89/166 |

FOREIGN PATENT DOCUMENTS

| | | | |
|---|---|---|---|
| 127278 | 6/1919 | United Kingdom | 89/166 |

*Primary Examiner*—Stephen C. Bentley

*Attorney, Agent, or Firm*—Harrington A. Lackey

[57] ABSTRACT

A light-weight, shoulder-firable, armor-penetrating gun characterized by a recoiling barrel confined to coaxial movement by a pair of longitudinally spaced bushings within the gun housing, the recoiling barrel being adapted to carry rearward the elongate bolt carrier containing the bolt for compressing the recoil spring, and a stop mechanism associated with the barrel and the housing for limiting the rearward travel of the barrel for early disengagement between the barrel and the bolt carrier, and a barrel spring in the front of the housing for returning the barrel to its normal battery position.

5 Claims, 10 Drawing Figures

ANTI-ARMOR GUN

BACKGROUND OF THE INVENTION

1. Field of the Invention

This invention relates to guns. More particularly, it relates to an armor-penetrating, shoulder-firable gun which has a substantially free-floating barrel, bolt and bolt carrier.

2. Description of the Prior Art

The recoil and weight of the Browning M-2 heavy-barrel machine gun (50 cal.), belt-fed, make it unsuitable for firing from the shoulder. The bolt-fed sniper rifle of smaller weight and caliber will not penetrate armored targets. The bolts of guns of a caliber that will penetrate armored targets are often broken by recoil because of excessive strain on the lock lugs. Thus, there is a need for a light-weight, shoulder-firable, armor-penetrating gun that can stand up to heavy duty use. After extended investigation I have come up with just such a gun.

SUMMARY OF THE INVENTION

A shoulder-firable gun made in accordance with this invention incorporates an elongated housing coaxially and slidably receiving an elongated barrel, a bolt carrier, and a bolt, which are free to recoil against the action of a rear recoil spring upon firing. The energy of the firing is partially absorbed by the barrel through the cooperating locking lugs, and also by the bolt which dissipates much of the energy through the bolt carrier to the recoil spring.

After a limited degree of rearward travel, the barrel to which is fixed a stop or abutment member engages a barrel travel limit stop fixed in the housing and encompassing the barrel. Barrel springs connected between the housing and the barrel in the front portion of the housing bias the barrel foward to its normal battery position, after the bolt has been disengaged from its locking position with the barrel.

The accuracy of the gun for long range firing is substantially increased by the transmittal of the recoil energy, not only through the barrel, but also through the bolt and particularly the bolt carrier working against the recoil spring. Moreover, the accuracy is further increased by the utilization of the front and rear bushings guiding the barrel in its longitudinal reciprocal movement.

The housing also preferably includes an elongated top cover having a non-circular or polygonal cross-section for guiding the barrel collar, barrel stop member, bolt head and bolt carrier in their longitudinal reciprocable movement within the housing.

The above features permit the usage by the gun of a single operator, instead of the two or three-men crews required for prior non-shoulder operated anti-armor guns, such as the Browning M-2 heavy-barrel, 50-caliber machine gun.

A further advantage of the gun is that its entire housing, including the receiver and the top cover, may be stamped from sheet metal.

BRIEF DESCRIPTION OF THE DRAWING

For a better understanding of my invention and certain preferred embodiments thereof, reference will now be made to the drawing which forms a part hereof.

In the drawing,

FIG. 2 shows the gun of the invention with a handle for retracting the bolt carrier to the rear held in a rearward position just prior to releasing.

FIG. 3 shows the components of the gun in their respective positions as a cartridge is raked out of the magazine.

FIG. 4 depicts the gun of the invention as a cam slot begins to work against a pin, causing the bolt to rotate.

FIG. 5 demonstrates how the moving parts of the gun of the invention take different positions as the trigger is released.

FIG. 6 shows how the bolt carrier rides back over the hammer of the gun of the invention, cocking it, as the firing action continues.

FIG. 7 indicates the further action of the gun of the invention as the bolt carrier continues rearward, the bolt is extracted and the barrel begins to move forward.

FIG. 8 shows how the firing cycle is completed when the bolt carrier stops and another cartridge is raked out of the magazine.

DETAILED DESCRIPTION OF THE INVENTION

Figure 1:
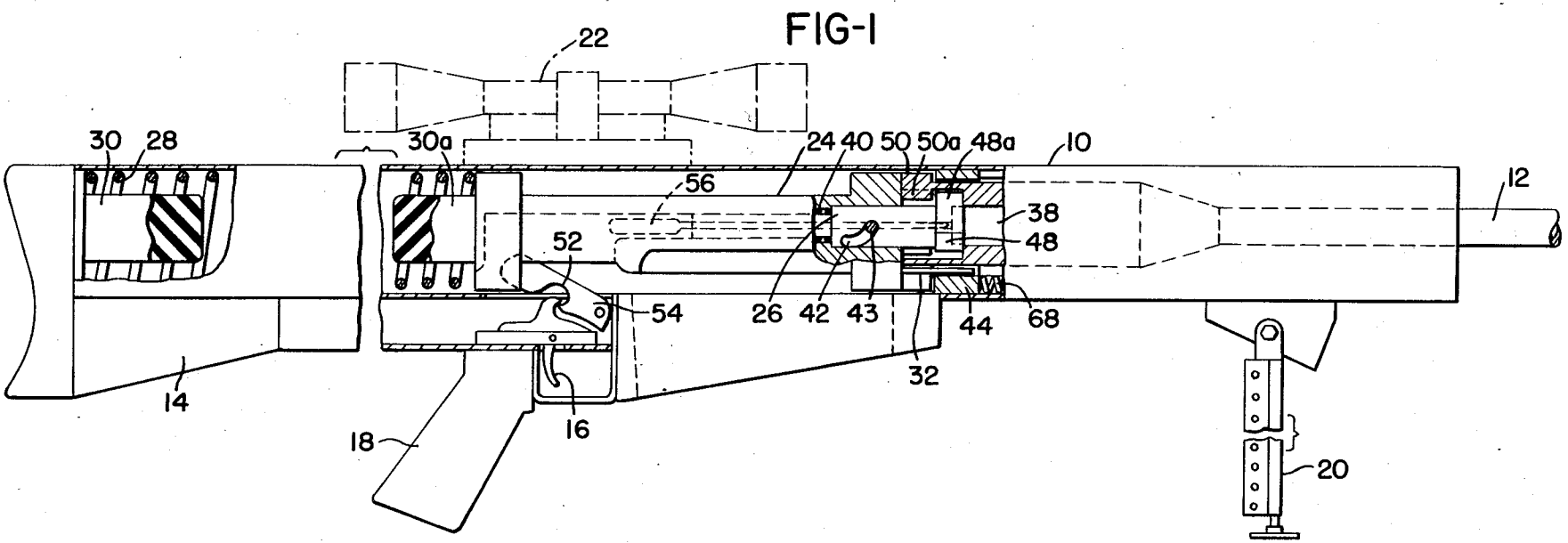
FIG. 1 is a general view of a representative gun according to the invention from one side, partially broken away to show the components within the housing, with the bolt forward, locked to the barrel and without a clip.

In the drawing (in which primed numbers refer to parts similar to or the same as unprimed number parts), the gun shown generally in FIG. 1 and more specifically described hereinbelow with respect to FIGS. 1–8, including FIG. 4A, has a housing 10, including a polygonal-shaped receiver and top cover, stock 14 handgrip 18, optional support legs 20, optional telescopic sight 22. Rear and front bumpers 30, 30*a* made of rubber or like material, are mounted in the rear-end portion of the housing 10 in opposite ends of the recoil spring 28. (FIG. 1). Fixed in about the middle of the housing 10 is a rear bushing 44. A front bushing 46 is fixed at the front-end of the housing. Both bushings 44 and 46 are provided with coaxially aligned openings for slidably receiving the elongated barrel 12.

Figure 2:
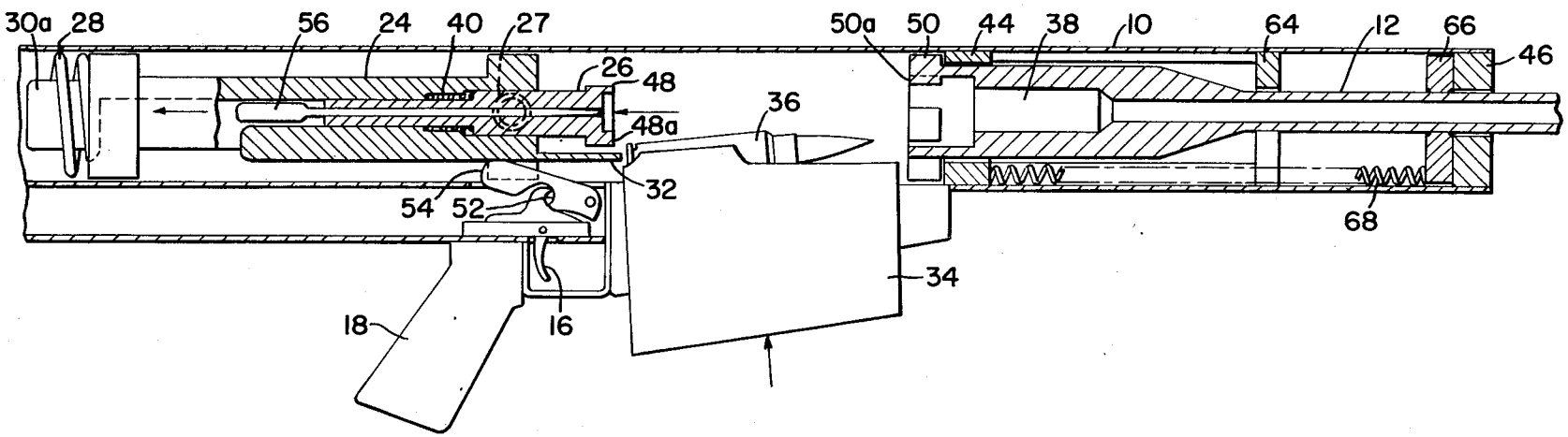
FIGS. 2 through 8 show the components of the gun of the invention in their various positions during the firing cycle before, during and after firing, the views being again from one side, and partially broken away and in longitudinal cross section except for the partial cross-sectional view of FIG. 4A.

Also fixed to the interior of the housing 10 between the front bushing 46 and the rear bushing 44 is a barrel travel limit stop 64 having an opening therethrough for freely receiving the longitudinal reciprocable movement of the barrel 12. An abutment member or stop 66 is secured to the exterior of the barrel 12 between the front bushing 46 and the barrel travel limit stop 64, as illustrated in two extreme positions in FIGS. 2 and 7, respectively. An elongated barrel spring 68 is connected between the barrel 12 and the housing 10, and specifically between the stop or abutment member 66 and the rear bushing 44, as illustrated in FIG. 2. Thus, the barrel 12 is normally biased forward to its battery position by the extension of the barrel spring 68, as illustrated in FIG. 2. However, when the barrel 12 is recoiling under the action of the expanding gases after firing, the barrel spring 68 is compressed by the stop 66 until the stop 66 engages the barrel travel stop 64, which limits the rearward movement or travel of the barrel 12, specifically within a limited distance of approximately four inches.

The rear-end portion of the barrel 12 is enlarged, as illustrated in the drawings, to contain a barrel chamber 38 for receiving a cartridge 36. The enlarged rear portion of the barrel 12 terminates in a bolt locking collar 50 which projects radially outward from the enlarged portion of the barrel to slidably engage the inside of the housing 10 including the top cover and the lower receiver, as illustrated in FIG. 4A. The interior of the bolt locking collar 50 is provided with circumferentially spaced, radially inward directed locking lugs 50*a* spaced rearward of the barrel chamber 38 to define a space for receiving the bolt head 48.

Bolt 26 is provided with an enlarged bolt head 48 divided into circumferentially spaced and radially outward projecting bolt lugs 48*a* which are adapted to be received in the space behind the barrel chamber 38 and in front of the bolt lugs 58, so that when the bolt 26 is rotated a predetermined angle, the bolt lugs 48*a* will engage and lock against the barrel locking lugs 50*a*.

The bolt 26 is adapted to be slidably received within a cavity in the front portion of the bolt carrier 24. The rear end of the bolt cavity defines a rear seat for an enlarged rear portion of the bolt 26 in order to limit the rearward travel of the bolt 26 within the bolt carrier 24. A bolt spring 40 is contained within a smaller cavity to the rear of the bolt cavity for urging the bolt 26 forward in the bolt cavity relative to the bolt carrier 24. The arrows 62 (FIG. 5) are pointing toward the seat within the bolt carrier 24 for limiting the rearward travel of the bolt 26. The bolt 26 is provided with a conventional firing pin 56.

Figure 4A:
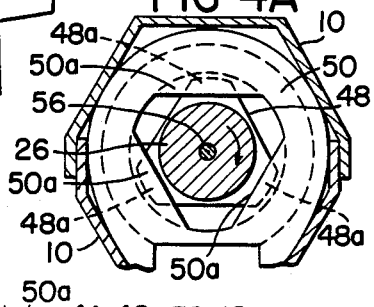
FIG. 4A is a vertical cross section taken at 4—4 of FIG. 4 showing the generally U shape of a representative cover or housing of a gun according to the invention.
Figure 4:
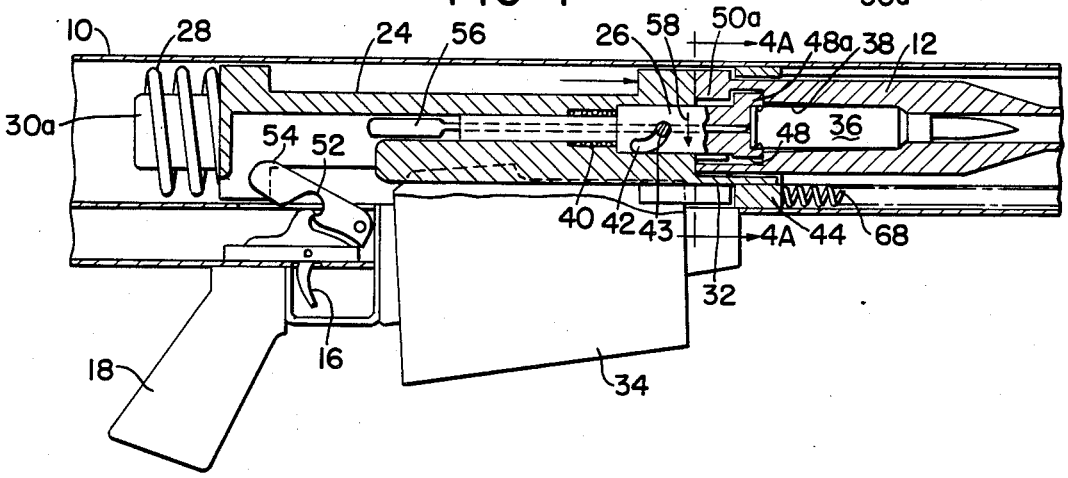
Figure 7:
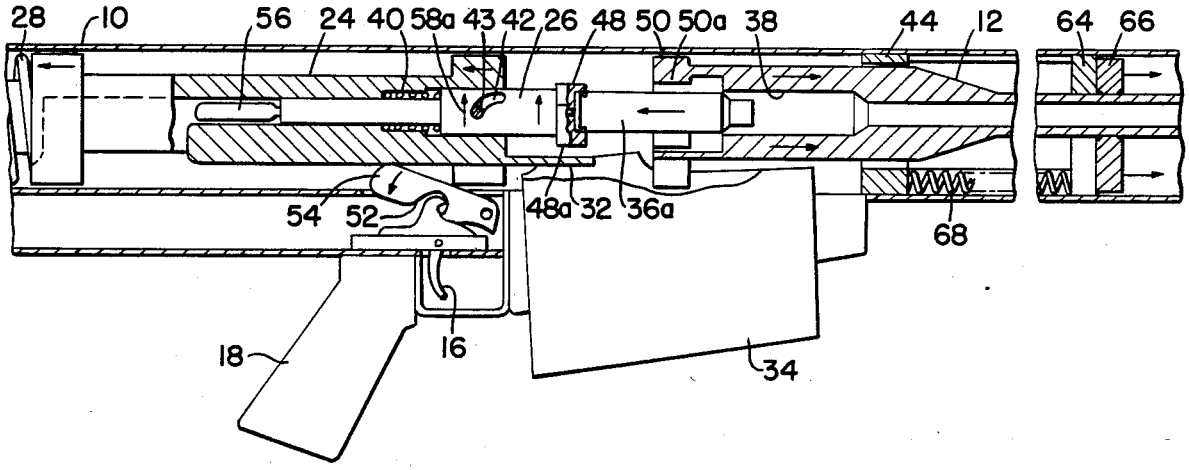
Figure 8:
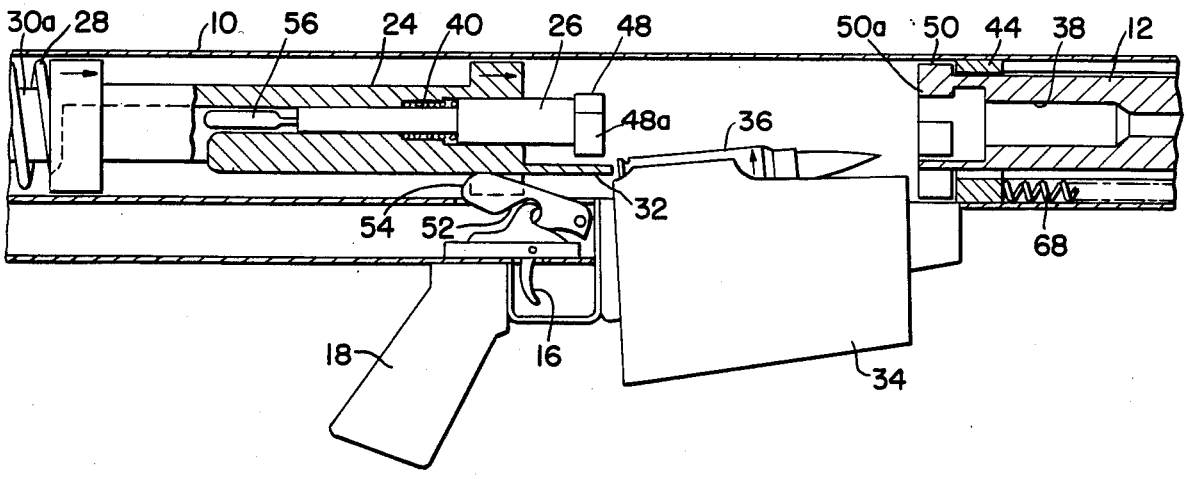

Arrows 58 and 58*a* in FIGS. 4 and 7 respectively, illustrate the respective rotational directions of the bolt 26 relative to the bolt carrier 24. Arrows 60 (FIG. 5) illustrate the transfer of energy from the bolt lugs 48*a* to the barrel lugs 50*a*; whereas, the arrows 62 illustrate the transfer of energy from the body of the bolt 26 through the cavity seat to the bolt carrier 24.

The trigger mechanism illustrated in FIGS. 1–8 includes a hand-grip 18, a trigger 16, and a hammer 54, including a sear notch 52.

A handle 27 (FIG. 2) is used for manually moving the bolt carrier 24 longitudinally within the receiver.

Cartridges 36 may be included in a magazine 34 which is in a cartridge cavity in the bottom of the receiver or housing 10, as illustrated in the drawings, and which generally functions in a conventional manner.

As illustrated in the drawings, a feed finger 32 is fixed to the bolt carrier 24 for extracting cartridges 36 from the magazine 34 and transferring the cartridge 36 into the cartridge or barrel chamber 38.

In operation, as shown in FIG. 2, retracting the bolt carrier 24 to the rear by handle 27 compresses the recoil spring 28. Releasing bolt carrier 24 allows it to fly forward under pressure of recoil spring 28.

Figure 3:
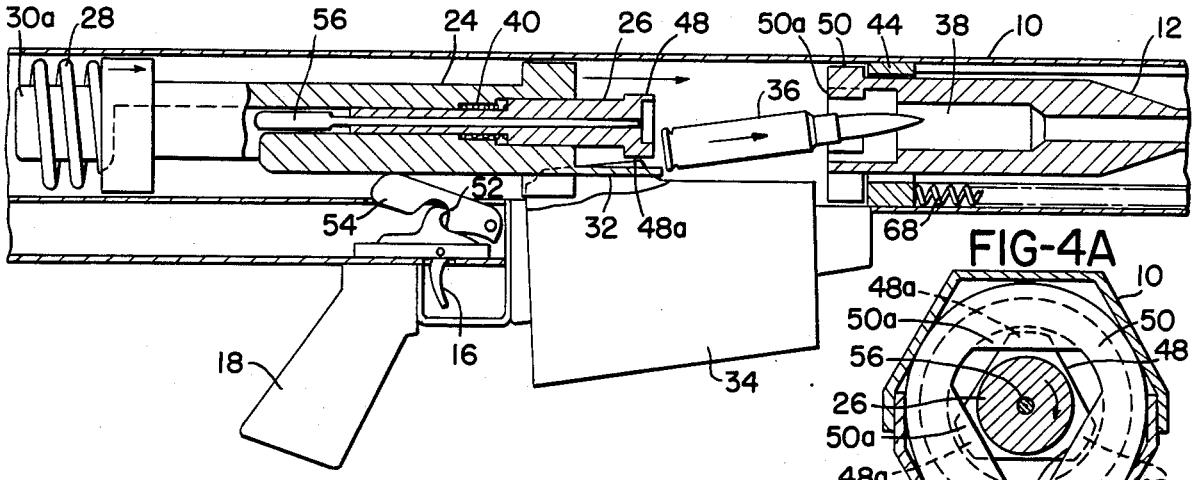

Referring now to FIG. 3, during its forward travel feed arm or feed bar 32 attached to bolt carrier 24 passes between the lips of the magazine 34 and rakes out a cartridge 36 (cf. blank shell 36*a* of FIG. 7), which is pushed up into the line of the bore and into the barrel chamber 38 of the barrel 12.

The firing cycle continues as shown in FIG. 4. When chambered, the bolt 26 that has been held forward by a bolt spring 40 begins to be compressed by the greater pressure of the recoil spring 28. A cam slot 42 cut into the side of the bolt 26 begins to work against a pin 43 fixed to the bolt carrier 24, causing the bolt 26 to rotate as the bolt carrier 24 closes. When the bolt carrier 24 is at its most forward position, it bears against a shoulder located midway along the bolt 26, thus pushing and locking the bolt 26 to the barrel 12.

Figure 5:
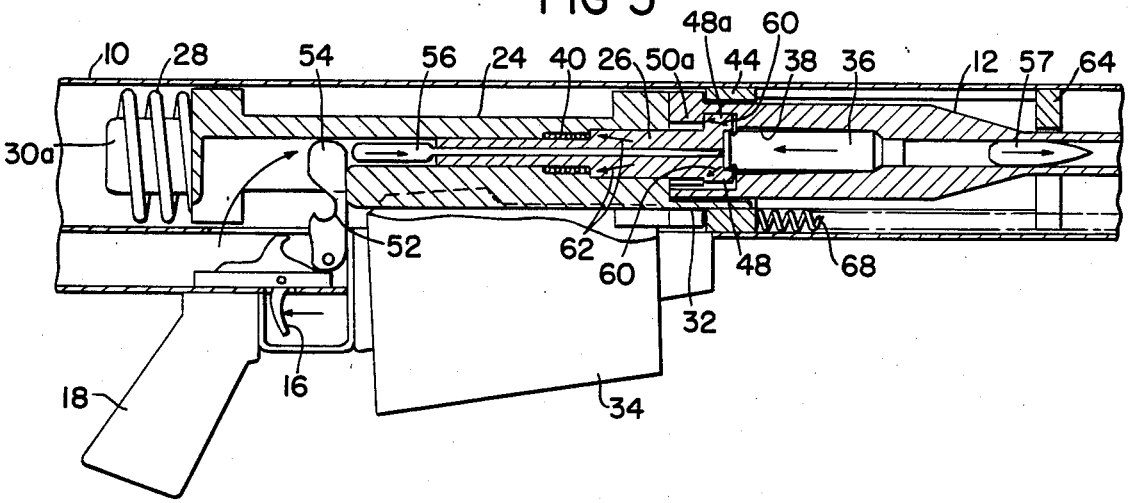

With respect to FIG. 5, pulling the trigger 16 then releases the sear notch 52 in the hammer 54, which, being spring loaded, slams up to the firing pin 56, which is pushed forward, crushing the cartridge primer and firing the projectile 57. Recoil generated from the fired cartridge pushes against the bolt face, that energy being passed to the bolt collar locking lugs 48*a* on the bolt 26 that are locked to the barrel 12 by corresponding barrel collar locking lugs 50*a* (see also FIGS. 4 and 4A), transferring this energy to the barrel 12, causing it to recoil to the rear. This dead weight suddenly started to motion accounts for much of the dissipation of the heavy recoil which enables the gun of the invention to be fired from the shoulder. At the same time the energy passes to the locking lugs 48*a* and 50*a* it also passes through the body of the bolt 26, cavity seat, and into the bolt carrier 24 at its bearing point, starting it also to the rear and compressing the recoil spring 28.

Figure 6:
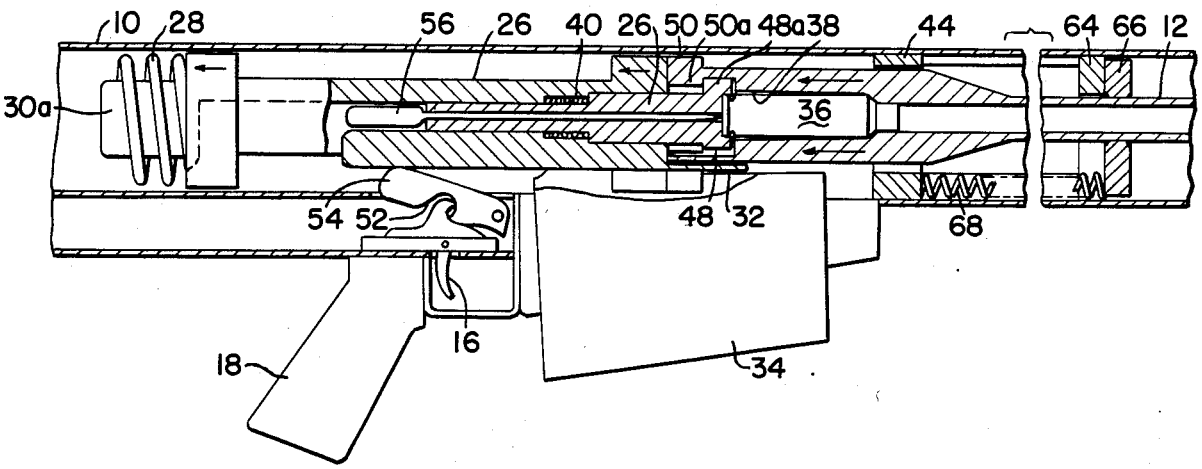

Referring now to FIG. 6, during its rearward travel the bolt carrier 24 rides back over the hammer 54, cocking it. This is in a manner similar to that of the Colt AR-15, which uses a similar assembly. During this rearward motion the bolt carrier 24 and barrel 26 are locked and moving together. When the barrel 12 has travelled about 4 inches or so, the abutment member 66 engages the barrel travel stop 64 to stop any further rearward travel.

In FIG. 7 the bolt carrier 24 is shown as it continues rearward under its own momentum. As it is pulled away from the barrel 12 (now stationary), the bolt 26 is extracted from the bolt carrier 24, causing the cam pin 43 in its side to rotate, thereby unlocking the bolt 26 from the barrel 12. The spent case 30*a* is ejected.

The barrel 12 now begins to move forward by means of a return spring 68 located underneath the barrel 12 and returns to battery. As viewed in FIG. 8, the bolt carrier 24 stops when the compressed recoil spring 28 overpowers the rearward motion, moving it forward again and raking a fresh cartridge out of the magazine 34 (see also FIG. 3).

Figure 9:
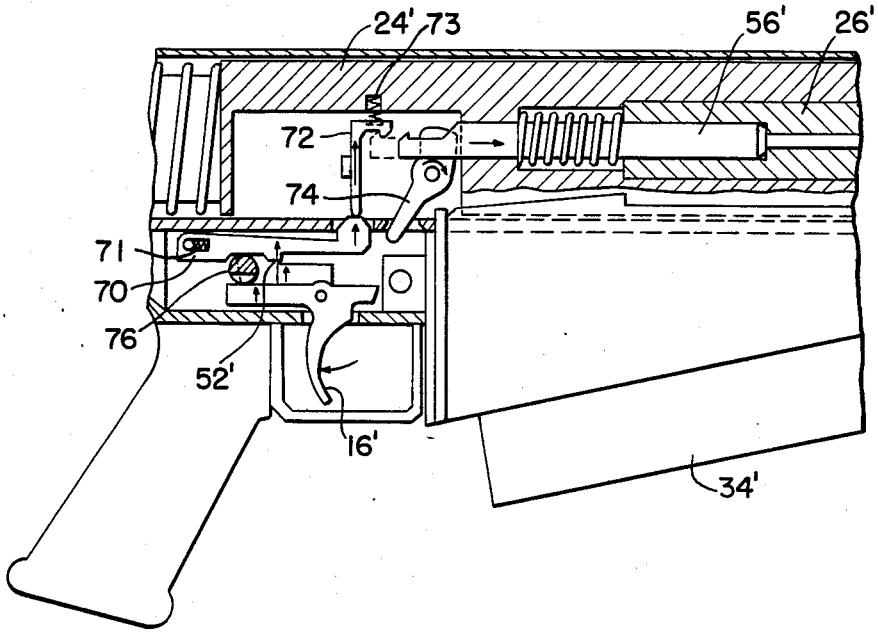
FIGS. 9 and 10 depict in views from one side, partially cut away to show longitudinal cross-sectional configurations of the components of the gun according to the invention having an alternative spring-loaded firing pin instead of the conventional hammer-fired arrangement in respective before-firing and after-firing positions.
Figure 10:
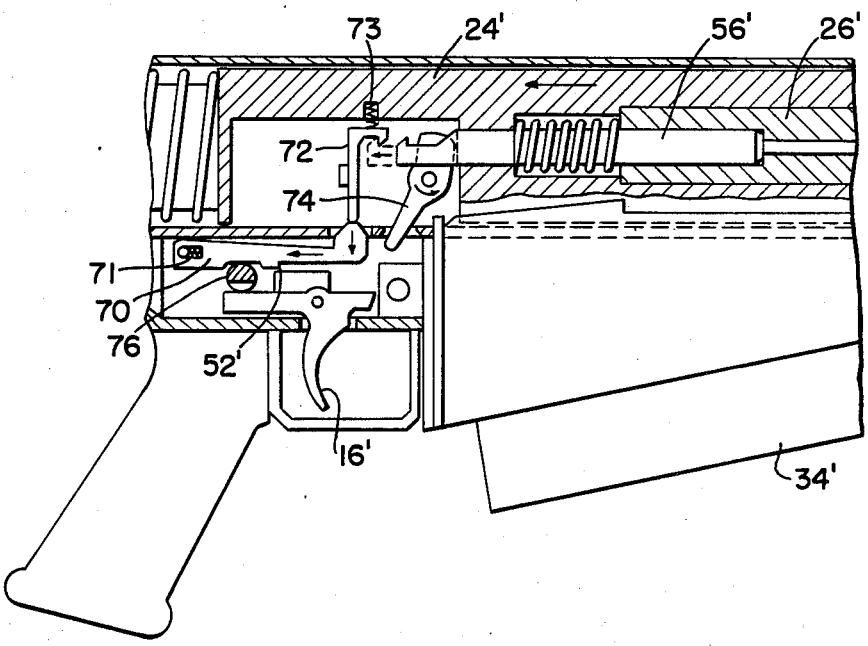

FIGS. 9 and 10 disclose a modified trigger mechanism. Those parts or elements which correspond to similarly numbered parts in FIGS. 1–8 are numbered with primed reference numerals. The trigger mechanism of FIGS. 9 and 10 includes a trigger 16 engaging a pin 76, which in turn engages an elongated pivotal transfer bar 70 including a spring 71. The transfer bar 70 operates upon a latch or sear 72 against a latch spring 73, and is provided with a hook adapted to cooperate with a cooperating hook on the rear of the firing pin 56' in the bolt 26', carried by the bolt carrier 24'.

In the spring-loaded firing pin arrangement of FIG. 9 and FIG. 10, when the safety 76 is turned to the proper position, the trigger 16' cannot move. As shown in FIG. 10, after firing, when the bolt carrier 24' moves to the rear, the cocking lever 74 inserted in a slot in the middle of the firing pin 56' pivots counter-clock-wise to recock the firing pin 56'. When the bolt carrier 24' rides back over a transfer bar 70 which has a spring 71, it pushes down and backward off of a sear notch 52'.

While the invention has been described in terms of preferred embodiments, the claims appended hereto are intended to encompass all embodiments which fall within the spirit of the invention.

Having thus described my invention and certain preferred embodiments thereof, I claim:

1. A shoulder-firable gun comprising:

(a) an elongated housing having a front portion, a rear portion, an upper portion, and a lower portion, said rear portion comprising a shoulder stock, (b) trigger mechanism in the lower portion of said housing, (c) an elongated bolt carrier received within said housing for longitudinal, reciprocable movement, said bolt carrier having a coaxial forward-opening bolt cavity, (d) an elongated bolt slidably received within and projecting forward from said bolt cavity, the front portion of said bolt comprising radially projecting bolt locking lugs and an elongated reciprocable coaxial firing pin, (e) said bolt cavity having a rear seat for engaging a rear portion of said bolt when said bolt is fully retracted within said cavity, (f) bolt spring means in said bolt carrier normally biasing said bolt forward, (g) cam and slot means interconnecting said bolt and bolt carrier to provide limited rotary movement of said bolt relative to said bolt carrier during longitudinal movement of said bolt relative to said bolt carrier, (h) an elongated recoil spring within said rear portion of said housing and in coaxial alignment with and behind said bolt carrier, (i) an elongated barrel comprising a rear barrel portion having a barrel chamber and terminating in an enlarged bolt locking collar, (j) said bolt locking collar having radially inward directed collar locking lugs for engaging and disengaging said bolt locking lugs in a battery position, (k) a front bushing fixed in the front end portion of said housing for slidably receiving said barrel for longitudinal reciprocable movement, (l) a rear bushing fixed in said housing substantially behind and in coaxial alignment with said front bushing and in front of said bolt locking collar, (m) a barrel travel stop member fixed within said housing between said rear bushing and said front bushing and encompassing at least a portion of said barrel, (n) an abutment member fixed on and substantially encompassing said barrel between said stop member and said front bushing to engage said stop member to limit the rearward movement of said barrel, (o) barrel spring means connecting said barrel to said housing to bias said barrel forward to a battery position, (p) said bolt locking lugs counter-rotating and disengaging said collar locking lug after said abutment member engages said stop member during the rearward travel of said barrel, whereby said bolt carrier continues its rearward movement against the action of said recoil spring while said bolt rotates forward relative to said bolt carrier, and said barrel is biased forward to its battery position by said barrel spring.

2. The invention according to claim 1 in which said bolt locking collar has an outer periphery of non-circular cross-section to slidably engage the interior surface of said housing during its longitudinal reciprocable movement.

3. The invention according to claim 1 in which said housing comprises a lower receiver portion and a top cover cooperating to close said receiver.

4. The invention according to claim 3 in which said housing has a polygonal cross-section.

5. The invention according to claim 1 further comprising stop means on said barrel for engaging a bushing to limit the forward movement of said barrel relative to said housing.

* * * * *